United States Patent [19]

Haramoto et al.

[11] 4,139,728

[45] Feb. 13, 1979

[54] SIGNAL PROCESSING CIRCUIT

[75] Inventors: Yutaka Haramoto, Zama; Yasuhiko Fujii, Yokohama; Masami Yamazaki, Zama, all of Japan

[73] Assignee: Victor Company of Japan, Ltd., Yokohama, Japan

[21] Appl. No.: 786,675

[22] Filed: Apr. 11, 1977

[30] Foreign Application Priority Data

Apr. 13, 1976 [JP] Japan ..... 51-41641

[51] Int. Cl.[2] ..... H04R 5/00

[52] U.S. Cl. ..... 179/1 G

[58] Field of Search ..... 179/1 G, 1 GQ, 1 J, 179/100.1 TD, 100.4 ST

[56] References Cited

U.S. PATENT DOCUMENTS

| | | | |
|---|---|---|---|
| 3,088,997 | 5/1963 | Bauer | 179/1 G |
| 3,110,771 | 11/1963 | Logan et al. | 179/1 J |
| 3,236,949 | 2/1966 | Atal et al. | 179/1 G |
| 3,920,904 | 11/1975 | Blauert et al. | 179/1 G |
| 3,970,787 | 7/1976 | Searle | 179/1 G |
| 4,027,101 | 5/1977 | DeFreitas et al. | 179/1 J |

*Primary Examiner*—Douglas W. Olms

*Attorney, Agent, or Firm*—Haseltine, Lake & Waters

[57] ABSTRACT

A signal processing circuit has a circuit organization having a pair of crosstalk circuits respectively including at least delay circuits each of a delay time $\tau$ and adapted to add or cancel crosstalk components to or in input signals in correspondence with the transfer characteristics between sound sources and the two ears of a listener. Each crosstalk circuit has means for attenuating components of frequencies represented by $(2n-1/2\tau)$ (where n is a positive integer).

9 Claims, 15 Drawing Figures

CROSSTALK CKT
SUBTR
ADD
FREQ CHARAC
DELAY
COMB FILT
21
22
23
24
25
26
27
28
29
30
31
32
33
34
61
62
63
64
65
66
67
68
69
70
71
72
73
74

RESPONSE (db)
0
-10
I
II
FREQUENCY(Hz)

SIGNAL PROCESSING CIRCUIT

BACKGROUND OF THE INVENTION

The present invention relates generally to signal processing circuits, and more particularly to an improvement of a signal processing circuit such as a circuit for electrically generating binaural signals, circuits for eliminating crosstalk with respect to the two ears of a human being at the time when binaural signals are converted into sound with speakers, and combinations of these circuits.

A so-called binaural system in which microphones are provided at the positions of the two ears of a dummy head having the shape of a human head to record the sounds respectively at the positions of the two ears, and the sounds obtained by reproducing these recorded sounds are respectively supplied to the headphone speakers for respective ears of a headphone set is known. By using this system, the listener can hear these sounds as though the position of the acoustic image were at the same position as that of the actual sound source.

In order to obtain this binaural signal, a dummy head must be used, heretofore. Accordingly, a signal processing circuit for obtaining signals substantially equivalent, electrically, to binaural signals from an ordinary monaural signals or respective channel signals of stereo signals was devised. By the use of this signal processing circuit, substantially binaural signals can be obtained without the use of a dummy head.

However, the transmission characteristic of a signal processing circuit of this type known heretofore has large dips at specific frequencies, and the signal components of these frequencies become missing.

Furthermore, when binaural signals are applied to speakers disposed at positions separated from the listener, and a reproduced acoustic field is formed, sounds which originally should have been introduced by headphones separately unto respective ears of the listener are heard by both ears. For this reason, crosstalks of sounds are produced with respect to the two ears. Accordingly, a circuit for processing signals in a manner such that crosstalk components are electrically cancelled was devised. In accordance with this signal processing circuit, when binaural signals are applied to speakers separated from the listener, it can be heard as sounds of a binaural system.

However, the transmission characteristic of a signal processing circuit of this character known heretofore exhibits high peaks at specific frequencies. This has given rise to the problem of the occurrence of distortion in signal components of the frequencies showing the peaks during the amplification of the output signal of this signal processing circuit with an amplifier.

Another signal processing circuit which has been devised is a combination of the above described two kinds of signal processing circuits. In this combined circuit, binaural signals obtained from monaural signals or respective channel signals of stereo signals are emitted as sound from speakers at positions separated from the listener, and the listener is thereby able to hear sounds in an acoustic field resembling the binaural system.

This signal processing circuit has a transmission characteristic which is a combination of the transmission characteristics of the above described two kinds of signal processing circuits. Then, since the frequencies of the dips of the above described two signal processing circuits and the peak frequencies are respectively different, this combined signal processing circuit has dips and peaks in its transmission characteristic. For this reason, this circuit has a combination of the drawbacks of the above described two signal processing circuits.

SUMMARY OF THE INVENTION

Accordingly, it is a general object of the present invention to provide a novel and useful signal processing circuit in which the above described difficulties have been overcome.

Another and specific object of the invention is to provide a signal processing circuit which is capable of producing s substantially binaural signals from ordinary monaural signals or respective channel signals of stereo signals without the occurrence of dips in its transmission characteristic.

Still another object of the invention is to provide a signal processing circuit capable of obtaining from binaural signals, without the occurrence of peaks in its transmission characteristic, signals which are to be emitted as sound from speakers at positions separated from a listener and are so applied to the speakers that the listener obtains the same hearing sensation as the binaural sensation which he would feel if he were to hear the binaural signals separately with respective ears.

A further object of the invention is to provide a signal processing circuit capable of obtaining from a monaural signal or respective channel signals of stereo signals, without the occurrence of dips and peaks in its transmission characteristic, signals which are to be emitted as sound from speakers at positions separated from a listener and are so applied to the speakers that the listener obtains the same hearing sensation as the binaural sensation he would feel if he were to hear the binaural signals separately with respective ears.

Other objects and further features of the invention will be apparent from the following detailed description with respect to preferred embodiments of the invention when read in conjunction with the accompanying drawings.

DETAILED DESCRIPTION

As a first embodiment of the present invention, a signal processing circuit for obtaining substantially binaural signals from monaural signals or respective channel signals of stereo signals will first be described.

Figure 1:
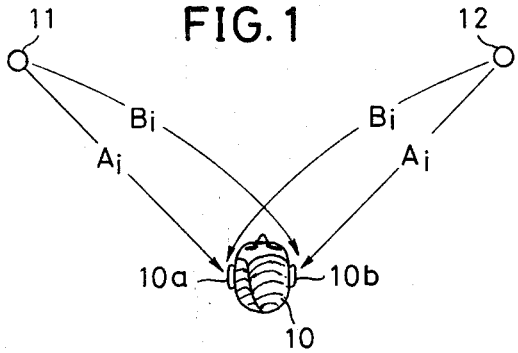
FIG. 1 is a diagrammatic plan view for a description of a transfer characteristic between sound sources and the two ears of a listener.

It will be assumed that, as illustrated in FIG. 1, sound sources 11 and 12 are positioned in symmetrical relationship in front of a listener 10 and on the left and right, respectively, as viewed from the listener 10. The transfer characteristics from the left sound source 11 to the left and right ears 10*a* and 10*b* of the listener will be denoted by Ai and Bi, respectively. Then the transfer characteristics from the right sound source 12 to the right and left ears 10*b* and 10*a* of the listener are Ai and Bi, respectively.

Heretofore, binaural signals were obtained under these conditions by placing a dummy head at the position of the listener 10 and installing microphones respectively at the positions of the ears 10*a* and 10*b* thereby to receive sounds and generate corresponding signals. In this case, the microphone at the position of the left ear 10*a* receives the sound of the left sound source 11 with the transfer characteristic Ai and the sound of the right sound source 12 with the transfer characteristic B*i*, while the microphone at the position of the right ear 10*b* receives the sound of the right sound source 12 with the transfer characteristic Ai and the sound of the left sound source 11 with the transfer characteristic B*i*.

Then, in order to obtain binaural signals from the signals of the left and right channels of the sound sources 11 and 12, for example, portions of the left and right channel signals are respectively added to the right and left channel signals with respective specific transfer characteristics.

Figure 2:
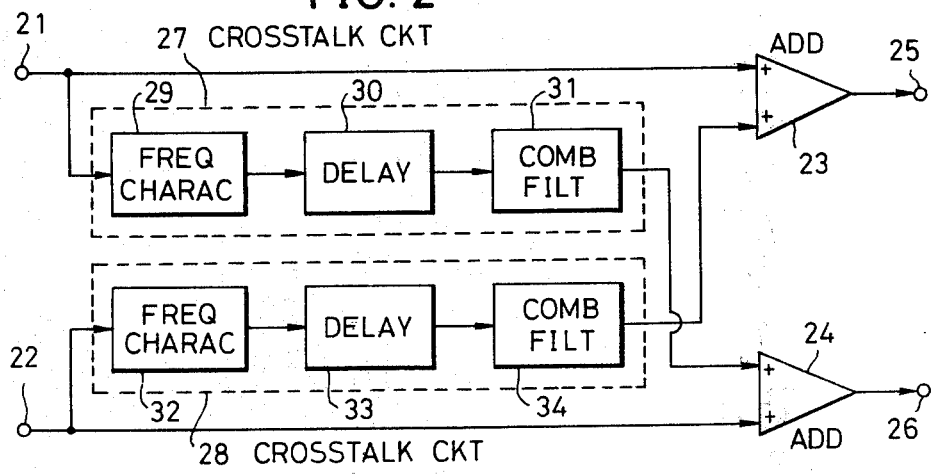
FIG. 2 is a block schematic diagram of a first embodiment of a signal processing circuit according to the present invention.

FIG. 2 is a block diagram showing the general organization of a first embodiment of a signal processing circuit constituting of the invention which is capable of obtaining binaural signals in this manner and, moreover, has a good transmission characteristic. The circuit shown in FIG. 2 has input terminals 21 and 22 to which are separately supplied with left and right channel signals of known stereo signals, for example. The signal introduced through the input terminal 21 is supplied to an adder 23 and a frequency characteristic imparting circuit 29 of a cross-talk adding circuit 27. The signal introduced through the input terminal 22 is supplied to an adder 24 and a frequency characteristic imparting circuit 32 of a crosstalk adding circuit 28.

Figure 3:
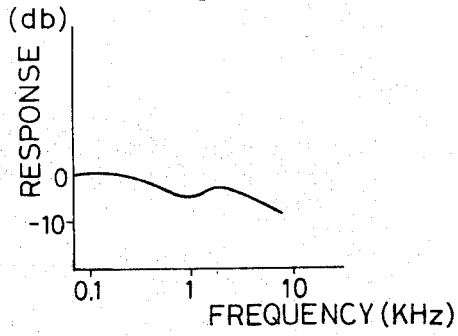
FIG. 3 is a graph indicating the frequency-response characteristic of a frequency characteristic difference between the two ears of a listener or of a circuit for imparting a frequency characteristic.

Each of the frequency characteristic imparting circuits 29 and 32 has a specific frequency response characteristic as indicated in FIG. 3, for example. This frequency response characteristic corresponds to a characteristic of a difference between the frequency characteristics between two ears of a listener and a sound source at a position offset to the left or the right from the direct front or straightforward direction of the listener. FIG. 3 indicates the frequency response characteristic in the case where the sound source is at a position offset by 45 degrees from the straightforward direction of the listener. This frequency response characteristic is selected in accordance with the selection of the angular position of reproduced acoustic image.

Figure 4:
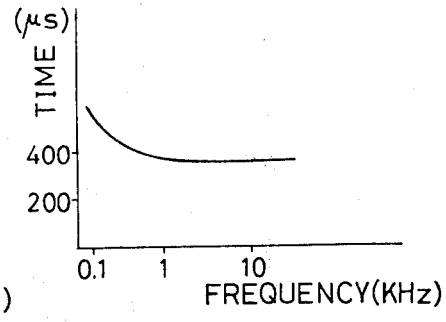
FIG. 4 is a graph indicating a delay characteristic between the two ears.

The signals to which the characteristic indicated in FIG. 3 has been imparted by the frequency characteristic imparting circuits 29 and 32 are respectively delayed by a specific time $T_1$ in delay circuits 30 and 33. The delay time $T_1$ is selected in accordance with a characteristic of a delay between two ears of the listener shown in FIG. 4. The resulting output signals of these delay circuits 30 and 33 respectively pass through comb filters 31 and 34 constituting essential parts of the circuit of the invention and are applied respectively to the adders 24 and 23. In the adder 23, the signal from the input terminal 21 and the signal from the comb filter 34 are added, while in the adder 24, the signal from the input terminal 22 and the signal from the comb filter 31 are added.

In the present embodiment of the invention, the above mentioned transfer characteristic Ai is selected at one (unity), and the transfer characteristics of the crosstalk adding circuits 27 and 28 are respectively made to be the above mentioned Bi. Accordingly, from output terminals 25 and 26, signals which have been rendered into substantially binaural signal capable of orientating the reproduced acoustic image at the positions of the sound sources 11 and 12 are led out.

In a known circuit, the comb filters 31 and 34 are not provided, and the output signals of the delay circuits 30 and 33 are supplied directly to the adders 24 and 23. Here, the case wherein signals of the same level are applied respectively to the input terminals 21 and 22 will be considered. Of these signals, frequency component signals of a frequency $1/2\tau_1$ and odd-number multiples thereof are applied with opposite phase to the two inputs of each of the adders 23 and 24. Therefore, with respect to the above mentioned frequency component signals, subtraction is essentially carried out in the adders 23 and 24, and in the output signals thereof, the components of the above mentioned frequency are remarkably attenuated.

Figure 5:
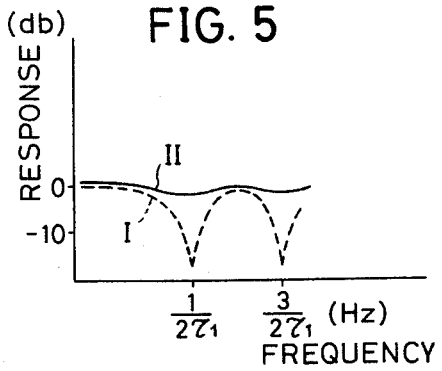
FIG. 5 is a graph indicating transmission characteristics between the input and output terminals of the signal processing circuit shown in FIG. 2 and a known signal processing circuit, and a characteristic of a comb filter.

Accordingly, in the case where the crosstalk adding circuits 27 and 28 comprise only the frequency characteristic imparting circuits 29 and 32 and the delay circuits 30 and 33, the transmission characteristics of the input terminals 21 and 22 and the output terminals 25 and 26 have large dips with respect to the input signals of the same phase and same level at frequencies represent by $(2n-1)/2\tau_1$ (where n is a positive integer) as indicated by intermittent line curve I in FIG. 5. As a consequence, in the signals led out of the output terminals 25 and 26, components of the frequencies $(2n-1)/2\tau_1$ are remarkably attenuated.

Accordingly, in accordance with the present invention, the comb filters 31 and 34 are provided in the crosstalk adding circuits 27 and 28. These comb filters 31 and 34 have comb filter characteristics substantially similar to that indicated by the intermittent line curve I in FIG.5 having the dips at the frequencies $(2n-1)/2\tau_1$. As a consequence, the components of the frequencies $(2n-1)/2\tau_1$ of the signals supplied from the comb filters 31 and 34 to the adders 23 and 24 are in attenuated state. For this reason, even when signals of the same phase and same level are introduced through the input terminals 21 and 22, the components of frequencies $(2n-1)/2\tau_1$ applied, with opposite phases relative to those of the signals from the input terminals 21 and 22, from the crosstalk adding circuits 27 and 28 to the adders 23 and 24 are in attenuated state, and essential subtraction of these frequency components is not carried out.

As a consequence, the transmission characteristics between the input terminals 21 and 22 and the output terminals 25 and 26 become as indicated by the full line curve II in FIG. 5, which does not have any dip and is substantially flat. Therefore, good binaural signals having also components of specific frequencies $(2n-1)/2\tau_1$ can be obtained from the output terminals 25 and 26.

Figure 6:
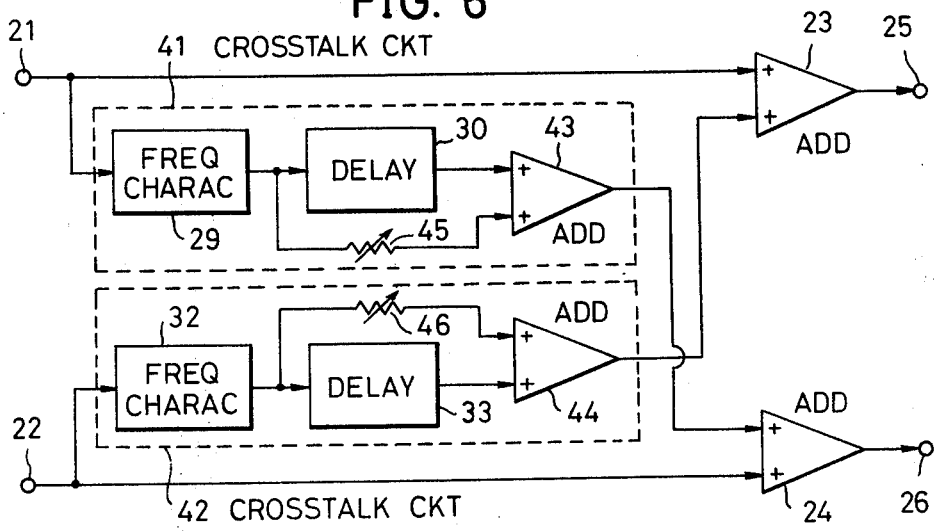
FIG. 6 is a block schematic diagram of a modification of the embodiment of the invention illustrated in FIG. 2.

A modification of the embodiment of the invention shown by block diagram in FIG. 2 is shown in FIG. 6. In FIG.6, those parts which are the same as corresponding parts in FIG.2 are designated by like reference numerals, and detailed description thereof will not be repeated. In crosstalk imparting circuits 41 and 42, the output signals of the frequency characteristic imparting circuits 29 and 32 are respectively supplied to adders 43 and 44 through the delay circuits 30 and 33, on one hand, and through resistors 45 and 46, on another hand. Here, the delay circuits 30 and 33, the adders 43 and 44, and the resistors 45 and 46 constitute, in essence, a comb filter having a comb filtering characteristic having dips at frequencies $(2n-1)/2\tau_1$.

Accordingly, by means of the circuit shown in FIG. 6, also, binaural signals can be similarly formed with the transmission characteristic indicated by the full line curve II in FIG. 5. It is to be noted that the adders 43 and 24 and the adders 44 and 23 may respectively be replaced by single adders each assuming the functions of two adders.

Figure 7:
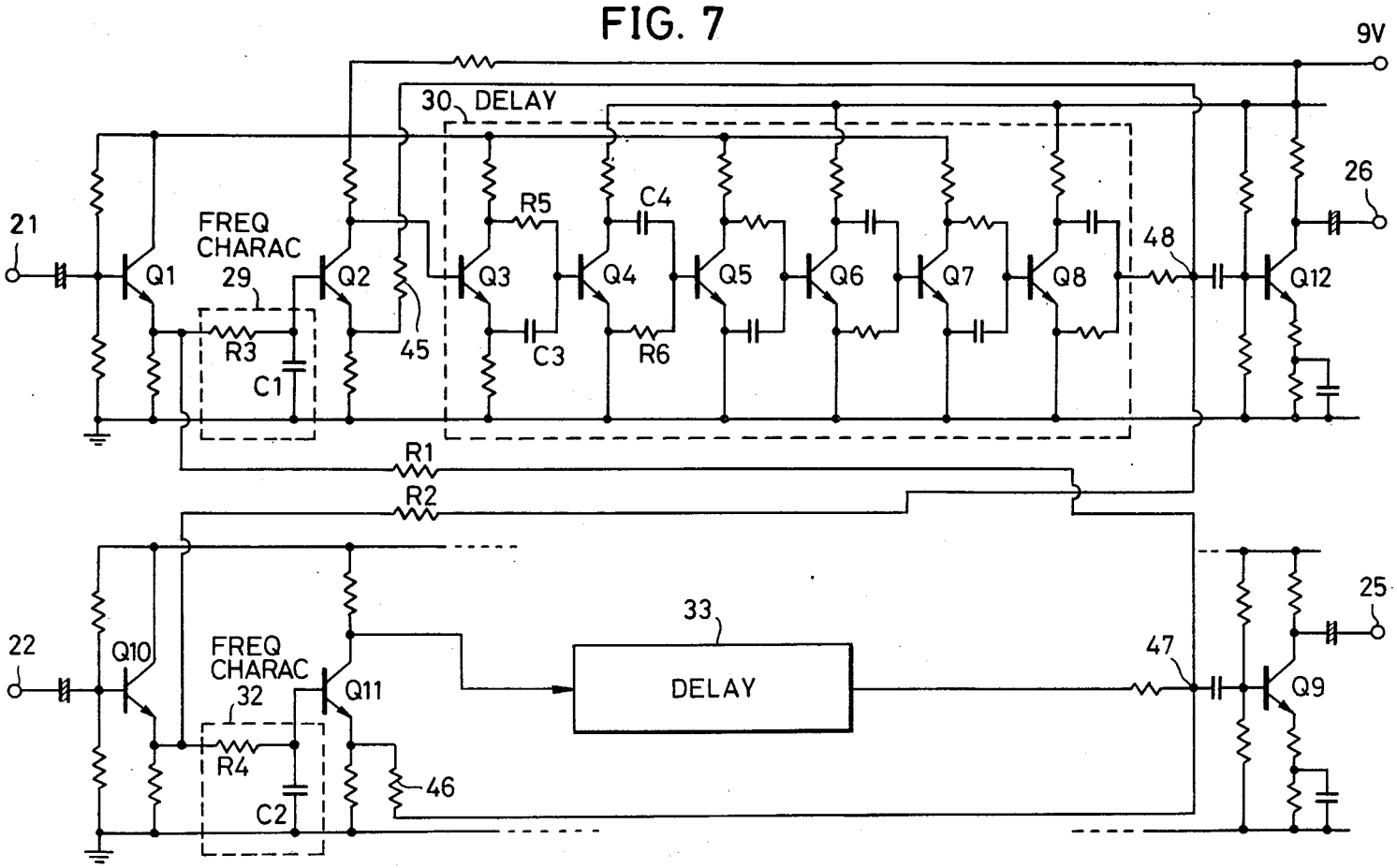
FIG. 7 is a circuit diagram of an embodiment of a specific electrical circuit in concrete form of the circuit shown in FIG. 5.

One embodiment of an actual signal processing circuit based on the block system shown in FIG. 6 is illustrated in concrete form in FIG. 7. Input signals introduced through the input terminals 21 and 22 are applied to the bases of transistors Q1 and Q10. The signals led out from the emitters of these transistors Q1 and Q10 are respectively supplied to frequency characteristic imparting circuits 29 and 32 and, at the same time, are applied by way of resistors R1 and R2 to points 47 and 48. The frequency characteristic imparting circuits 29 and 32 in the present embodiment of the invention are constituted by low-pass filter circuits (high-frequency range attenuation circuits) respectively comprising resistors R3 and R4 and capacitors C1 and C2. These circuits 29 and 32 impart to the input signals a high-frequency range attenuation characteristic as a characteristic approximating the characteristic indicated in FIG. 3. The characteristic of these frequency characteristic imparting circuits 29 and 32 may be caused to approximate even more closely the characteristic indicated in FIG. 3 by using inductance components.

The signal which have thus passed through the frequency characteristic imparting circuits 29 and 32 are applied to the bases of transistors Q2 and Q11. The signals obtained from the emitters of these transistors Q2 and Q11 are passed through the resistors 45 and 46 respectively applied to the points 48 and 47. The signals obtained from the collectors of the transistors Q2 and Q11 pass through the delay circuits 30 and 33, which impart to these signals a delay time $\tau_1$ (400 μsec. in the present embodiment of the invention), and are applied to the points 48 and 47. The delay circuit 30 comprises a plurality of stages (a total of 6 stages in the present embodiment of the invention) of phase-shifting circuits, each comprising, for example, a transistor Q3, a resistor R5, and a capacitor C3, and phase-shifting circuits, each comprising, for example, a transistor Q4, a resistor R6, and a capacitor C4, connected alternately in cascade connection. The delay circuit 33 is also of similar circuit organization, which is not shown in detail in FIG. 7.

At the above mentioned point 47, the signal from the input terminal 21 which has passed through the resistor R1 and the signal from the input terminal 22 which has passed through the frequency characteristic imparting circuit 32 and then has passed separately through the delay circuit 33 and the resistor 46 are added. Accordingly, the point 47 corresponds to the adders 23 and 44 in the circuit shown in FIG. 6. Similarly, at the above mentioned point 48, the signal from the input terminal 22 which has passed through the resistor R2 and the signal from the input terminal 21 which has passed through the frequency characteristic imparting circuit 29 and then has passed separately through the delay circuit 30 and the resistor 45 are added. Accordingly, the point 48 corresponds to the adders 24 and 44 in the circuit shown in FIG. 6.

The signals resulting from the above described additions at the points 47 and 48 are respectively amplified by transistors Q9 and Q12 and are led out as binaural signals from the output terminals 25 and 26.

Figure 8:
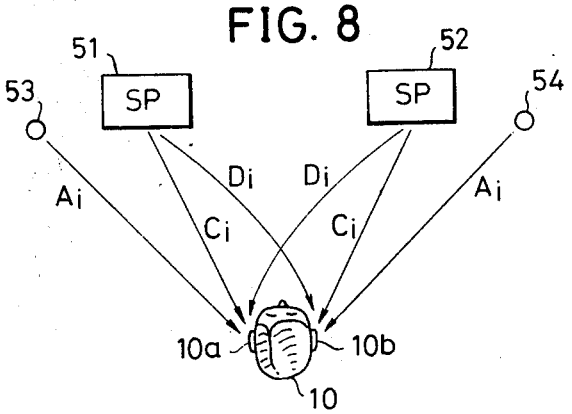
FIG. 8 is a diagrammatic plan view indicating transfer characteristics between speakers and the two ears of a listener.

FIG. 8 diagrammatically illustrates the case wherein binaural signals obtained in the manner described above or binaural signals obtained from microphones installed on a dummy head are applied to speakers 51 and 52 which are disposed symmetrically to the front of a listener 10 and thereby caused to be emitted as sound. The binaural sounds thus emitted by the speakers 51 and 52, fundamentally, should be transferred separately to the left and right ears 10*a* and 10b of the listener 10 with only the transfer characteristic Ci, whereby the listener can orientate, as a hearing sensation, acoustic images 53 and 54 as binaural sounds.

In an actual case, however, the sounds emitted by the speakers 51 and 52 are transferred to the listener's ears 10*a* and 10*b* with the transfer characteristic Ci and, in addition, are transferred to the ears 10*b* and 10*a* with a transfer characteristic Di as a crosstalk component. Accordingly, it is advantageous to effect a signal processing wherein signals for cancelling the crosstalk component transferred with this transfer characteristic Di are added beforehand to the signal to be applied to the speakers 51 and 52.

Figure 9:
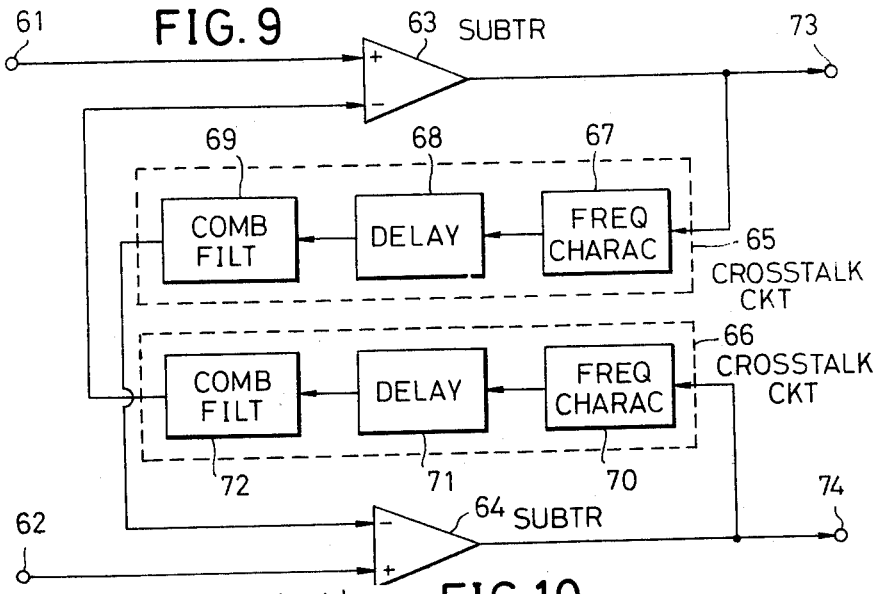
FIG. 9 is a block schematic diagram of a second embodiment of a signal processing circuit of the invention.

A second embodiment of a signal processing circuit of the invention in which signals for cancelling the crosstalk components are added beforehand to the binaural signals in this manner, and which, moreover, has a good transmission characteristic is illustrated in FIG. 9. In this circuit shown in FIG. 9, binaural signals obtained by the signal processing circuit constituting the above described first embodiment of the invention or binaural signals obtained from microphones installed on a dummy head are introduced through input terminals 61 and 62 and respectively supplied to subtractors 63 and 64. The output signals of these subtractors 63 and 64 are respectively supplied to frequency characteristic imparting circuits 67 and 70 of crosstalk circuits 65 and 66.

These frequency characteristic imparting circuits 67 and 70 have frequency response characteristics as indicated in FIG. 3, for example. While this frequency response characteristic differs with the angular positions of the speakers 51 and 52 with respect to the listener, it is as indicated in FIG. 3, for example, in the case where its angle is 45 degrees. The output signals of frequency characteristic imparting circuits 67 and 70 are respectively supplied to delay circuits 68 and 71 which impart a delay time $\tau_2$. The resulting output signals of these delay circuits 68 and 71 respectively pass through comb filters 69 and 72 constituting essential parts of the circuit of the invention and are supplied respectively to subtractors 64 and 63.

In the present embodiment of the invention, the above mentioned transfer characteristic C*i* is selected at one (unity), and the transfer characteristics of the crosstalk circuits 65 and 66 are respectively denoted by the above mentioned D*i*. Accordingly, the signal from the input terminal 62 which has been caused to have the transfer characteristic Di is subtracted in the subtractor 63 from the signal from the input terminal 61. Similarly, from the signal from the input terminal 62, the signal from the input terminal 61 which has been caused to have the transfer characteristic D*i* is subtracted in the subtractor 64. As a consequence, the output signals of the subtractors 63 and 64 resulting from the subtraction, beforehand, of the crosstalk component are led out through output terminals 73 and 74.

When these signals thus obtained through the output terminals 73 and 74 are applied to the speakers 51 and 52 in FIG. 8 thereby to be converted into and emitted as sounds, the listener 10 receives these sounds under the condition that the unnecessary crosstalks owing to transfer characteristic Di are cancelled and hears them as though acoustic images, as a hearing sensation, are orientated at positions 53 and 54.

The known circuit has been of an organization wherein the comb filters 69 and 72 are not provided in the crosstalk circuits 65 and 66, and the output signals of the delay circuits 68 and 71 are supplied directly to the subtractors 63 and 64. In this case, when signals of the same phase and the same level are applied to the input terminals 61 and 62, signals are applied with opposite phase relationship as two inputs of the subtractors 63 and 64 with respect to components of frequencies of $(2n-1)/2\tau_2$, and, as a result, addition is carried out in the subtractors 63 and 64. As a result, of the signals obtained through the ouput terminals 73 and 74, the components of frequencies $(2n-1)/2\tau_2$ are remarkably increased.

Figure 10:
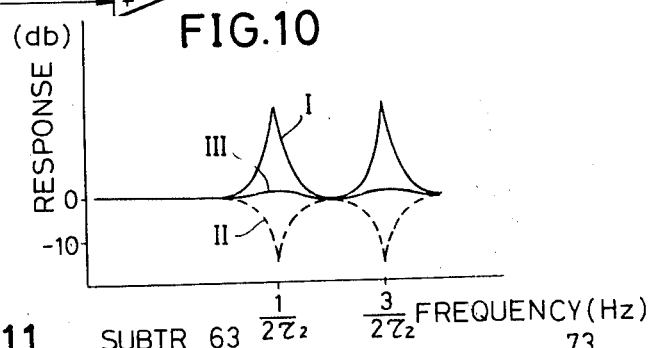
FIG. 10 is a graph indicating transmission characteristics between the input and output terminals of the signal processing circuit shown in FIG. 9 and a known signal processing circuit, and a characteristic of a comb filter.

Therefore, in the case of the above described known circuit organization, the signal transmission characteristics between the input terminals 61 and 62 and the output terminals 73 and 74 become characteristic having large peaks at frequencies $(2n-1)/2\tau_2$ as indicated by solid line curve I in FIG. 10.

Accordingly, in the circuit of the present invention, the comb filters 69 and 72 are provided in the crosstalk circuits 65 and 66. These comb filters 69 and 72 have comb filtering characteristics as indicated by intermittent line curve II in FIG.10 having dips at frequencies (2n-31 1)/$2\tau_2$. As a consequence, the components of frequencies $(2n-1)/2\tau_2$ of the signals supplied from the delay circuits 68 and 71 to the subtractors 64 and 63 are attenuated by these comb filters 69 and 72. For this reason, even when signals of the same phase and the same level are introduced through the input terminals 61 and 62, the components of frequencies $(2n-1)/2\tau_2$ applied with opposite phase, relative to the signals from the input terminals 61 and 62, from the crosstalk circuits 65 and 66 to the subtractors 63 and 64 are in attenuated state. Consequently, addition, in essence, of these frequency components is not carried out.

As a consequence, the transmission characteristics between the input terminals 61 and 62 and the output terminals 73 and 74 become as indicated by full line curve III in FIG. 10, which does not have a peak and is substantially flat. Therefore, excellent binaural signals for emission as sound from speakers, in which signals the components of the specific frequencies $(2n-1)/2\tau_2$ are not particularly emphasized, and, moreover, the crosstalk components between the speakers and the two ears of the listener have been cancelled beforehand, are obtained from the output terminals 73 and 74.

Figure 11:
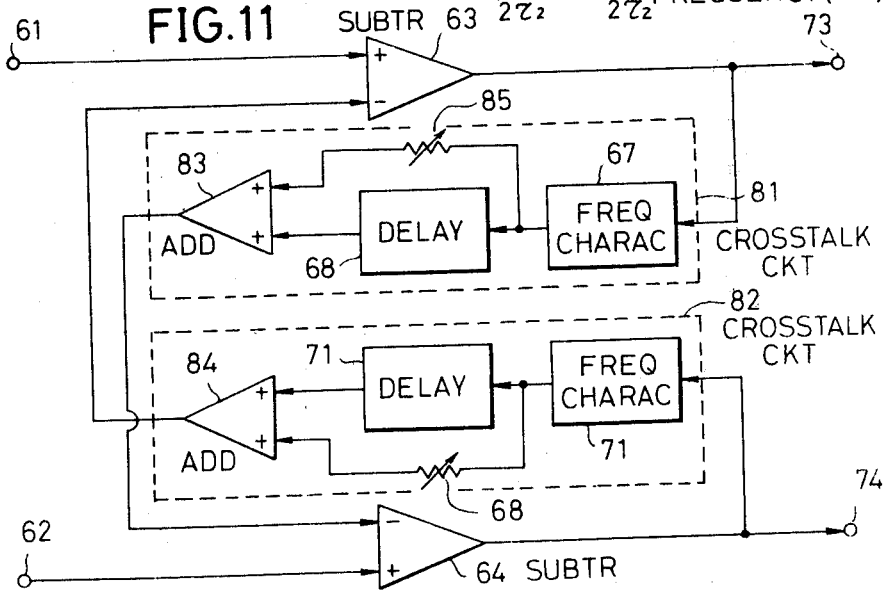
FIG. 11 is a block schematic diagram of a modification of the embodiment of the invention illustrated in FIG. 9.

A modification of the embodiment of the invention illustrated in FIG. 9 will now be described in conjunction with FIG. 11. In FIG. 11, those parts which are the same as corresonding parts in FIG. 9 are designated by like reference numerals, and detailed description thereof will not be repeated. In the crosstalk circuits 65 and 66, the output signals of the frequency characteristic imparting circuits 67 and 70, on one hand, respectively pass through the delay circuits 68 and 71 and are supplied to adders 83 and 84. Here, the delay circuits 68 and 71, the adders 83 and 84, and resistors 85 and 86 constitute, essentially, respective comb filters possissing comb filtering characteristics having dips at frequencies $(2n-1)/2\tau_2$.

Therefore, it is possible also by means of a circuit of the general organization shown in FIG. 11 to obtain in the same manner binaural signals which have transmission characteristic as indicated by full line curve III in FIG. 10, and in which crosstalk components have been canceled beforehand. As a modification in this circuit, instead of the subtractors 63 and 64, adders may be used, and inverters may be provided in the crosstalk circuits.

Figure 12:
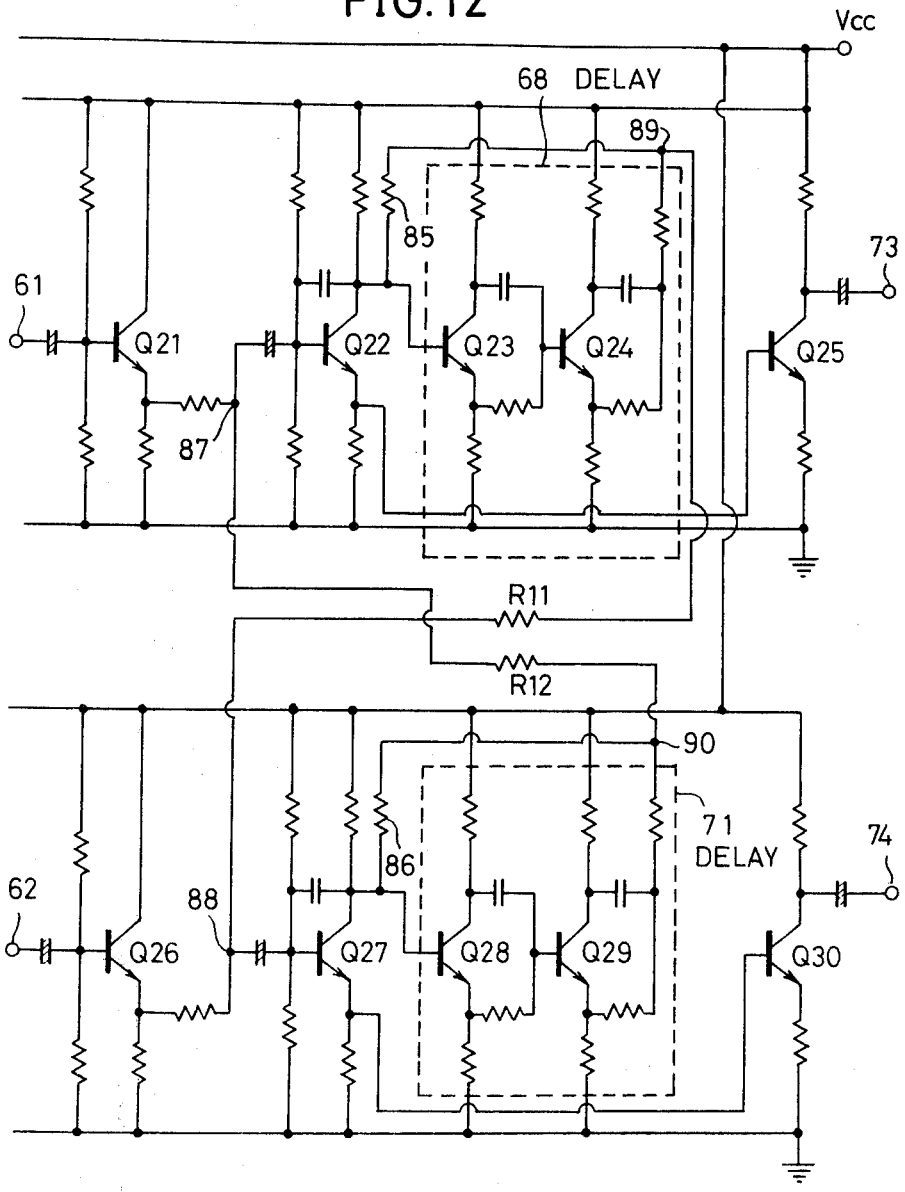
FIG. 12 is a circuit diagram showing an embodiment of a specific electrical circuit in concrete form of a further modification of the modified circuit shown in FIG. 11.

One embodiment of an actual signal processing circuit in concrete form which is a further modification of the circuit represented as a block diagram in FIG. 11 is shown in FIG. 12. In this circuit, input signals entering through the input terminals 61 and 62 are applied to the bases of transistors Q21 and Q26. Signals led out from the emitters of these transistors Q21 and Q26 are respectively applied by way of points 87 and 88 to the bases of transistors Q22 and Q27. Signals obtained from the emitters of these transistors Q22 and Q27 are respectively passed through transistors Q25 and Q30 and led out as output signals through the output terminals 73 and 74.

Signals which are led out from the collectors of the transistors Q22 and Q27 and have inverted phases are respectively applied, on one hand, by way of the resistors 85 and 86 and, on the other hand, by way of the delay circuits 68 and 71 to points 89 and 90. These points 89 and 90 correspond to the adders 83 and 84 in the circuit shown in FIG. 11. The delay circuits 68 and 71 respectively comprise two stages of phase-shifting circuits including transistors Q23 and Q24 and transistors Q28 and Q29. In the instant embodiment of the invention, the frequency characteristic imparting circuits 67 and 70 have been omitted in order to simplify the circuit organization.

Signals obtained at the points 89 and 90 are respectively applied through resistors R11 and R12 to the points 88 and 87 and added respectively to the input signals from the input terminals 62 and 61. Since the signals from the points 89 and 90 have been phase inverted relative to the input signals by the transistors Q22 and Q27, subtraction of signals, in essential effect, is carried out at the adding points 88 and 87.

Figure 13:
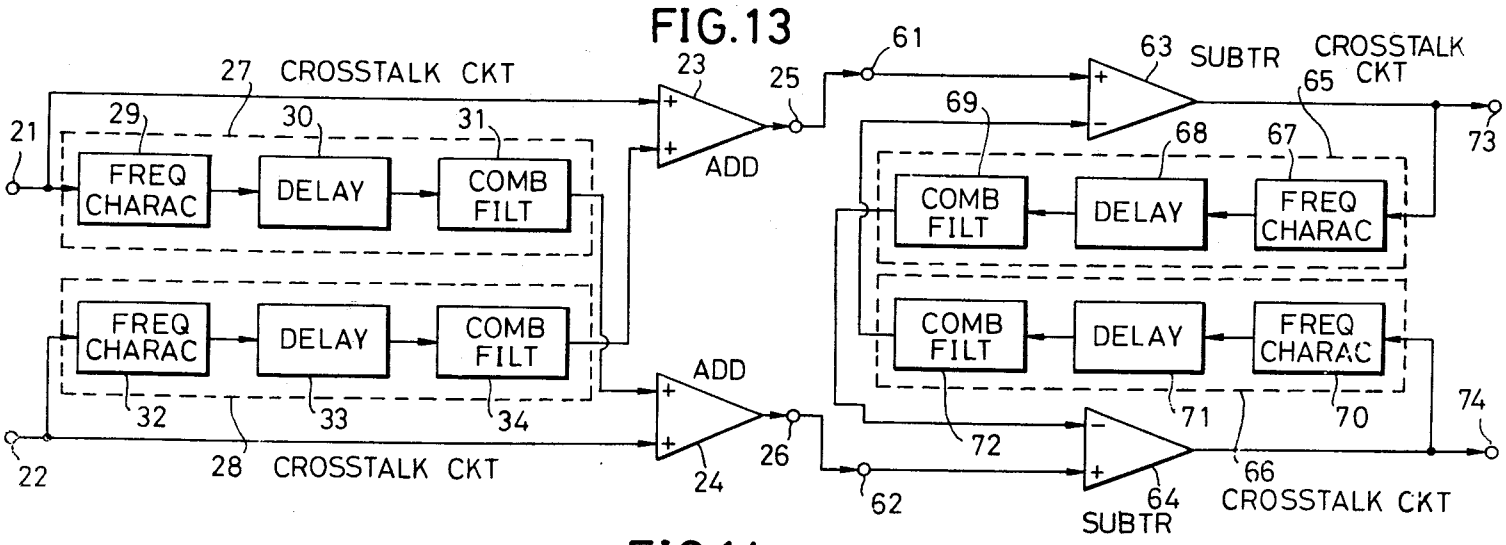
FIG. 13 is a block schematic diagram of a third embodiment of a signal processing circuit of the invention.

As a third embodiment of the present invention, a signal processing circuit comprising a combination in coupled state of the circuits illustrated in FIGS. 2 and 9 and constituting first and second embodiments of the invention is shown in FIG. 13. In FIG. 13, those parts which are the same as corresponding parts in FIGS. 2 and 9 are designated by like reference numerals, and detailed description thereof will not be repeated. In this circuit according to the present embodiment of the invention, when a monaural signal which does not have an acoustic image orientation or signals of the channels of a stereo signal are applied through the input terminals 21 and 22, binaural signals which can orientate an acoustic image are led out through the output terminals 25 and 26 as described hereinbefore in conjunction with FIG. 2. Furthermore, as described hereinbefore in conjunction with FIG. 9, binaural signals in which crosstalk components have been cancelled beforehand are led out through the output terminals 73 and 74.

Accordingly, by applying the output signals of the output terminals 73 and 74 to the speakers 51 and 52 shown in FIG. 8, reproduction can be accomplished in a manner such that acostic images are orientated at positions 53 and 54, for example, through the use of a monaural signal not having acoustic image orientation or a stereo signal. For this reason, there is formed an acostic field which is expanded more broadly than an acoustic field reproduced by merely applying a monaural signal or a stereo signal to the speakers 51 and 52.

Figure 14:
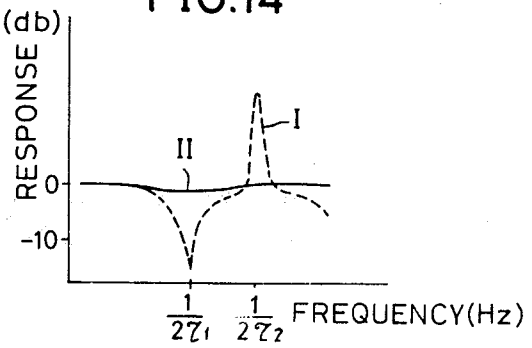
FIG. 14 is a graph indicating the transmission characteristics between the input and output terminals of the signal processing circuit shown in FIG. 13 and a known signal processing circuit.

Here, in a signal processing circuit which does not have the comb filters 31, 34, 69, and 72, the transmission characteristic of the entire circuit becomes one having dips at frequencies of $(2n-1)/2\tau_1$ and having peaks at frequencies of $(2n-1)/2\tau_2$ as indicated by intermittent line curve I in FIG. 14. In contrast, in the circuit of the present embodiment of the invention, the transmission characteristic of the entire circuit is substantially flat as indicated by the full line curve II in FIG. 14 because of the provision of the comb filters 31, 34, 39, and 72 as will be readily understood from the foregoing description of the preceding embodiments of the invention.

Figure 15:
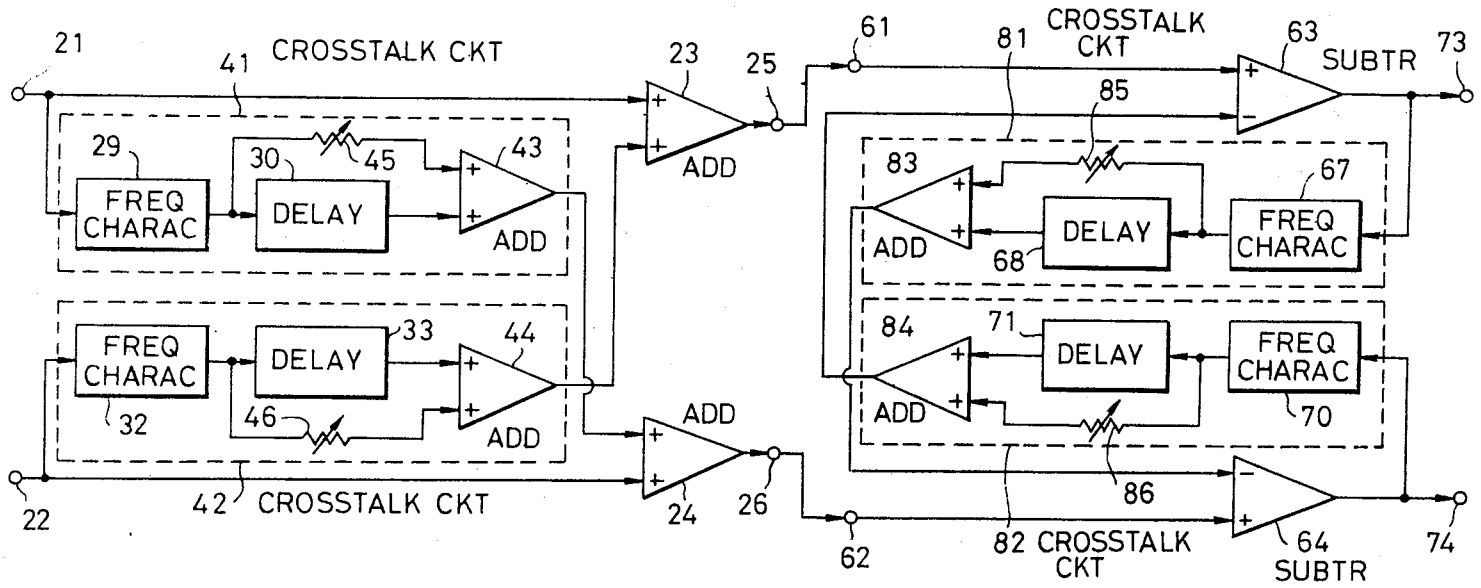
FIG. 15 is a block schematic diagram of a modification of the embodiment of the invention shown in FIG. 13.

The embodiment of the invention illustrated in FIG. 13 may be modified as shown in FIG. 15. In this modification, the modifications illustrated in FIGS. 6 and 11 are combined. In FIG. 15, those parts which are the same as corresponding parts in FIGS. 6 and 11 are designated by like reference numerals. Description of the circuit organization and operation of this circuit shown in FIG. 15 will be omitted since they can be readily understood from the foregoing description with respect to the preceding embodiments of the invention and modifications thereof.

Further, this invention is not limited to these embodiments but various variations and modifications may be made without departing from the scope and spirit of the invention.

What is claimed is:

1. A signal processing circuit comprising:

a first crosstalk circuit including a delay circuit of a delay time $\tau$ and imparting a specific transfer characteristic to a first input signal;

a second crosstalk circuit including a delay circuit of the delay time $\tau$ and imparting a specific transfer characteristic to a second input signal;

first addition means for adding the output signal of the first crosstalk circuit and the second input signal;

second addition means for adding the output of the second crosstalk circuit and the first input signal; and means for deriving output binaural signals respectively from the first and second addition means, said first and second crosstalk circuits further having, respectively, means for attenuating components of specific frequencies defined by $(2n-1)/2\tau$ (where n is a positive integer) of the signals passing through the crosstalk circuits.

2. A signal processing circuit as claimed in claim 1 in which the attenuating means comprises comb filters possessing comb filtering characteristics having dips at said specific frequencies.

3. A signal processing circuit as claimed in claim 1 in which the attenuating means comprises means for adding the output signals of the delay circuits and the input signals of the delay circuits passed through resistors.

4. A signal processing circuit as claimed in claim 1 in which the first and second crosstalk circuits further have frequency characteristic imparting circuits having respectively frequency characteristics substantially corresponding to the differences between the frequency characteristics at the two ears of a listener with respect to a sound source.

5. A signal processing circuit for biphonic use comprising:

first and second subtraction means respectively supplied with first and second input signals and substantially carrying out subtraction;

a first crosstalk circuit including a delay circuit of a delay time $\tau$ and operating to impart a specific transfer characteristic to the output signal of the first subtraction means, an output of the first crosstalk circuit being supplied to the second subtraction means;

a second crosstalk circuit including a delay circuit of the delay time $\tau$ and operating to impart a specific transfer characteristic to the output signal of the second subtraction means, an output of the second crosstalk circuit being supplied to the first subtraction means; and a circuit for deriving output signals from the first and second subtraction means, said first and second crosstalk circuits further having, respectively, means for attenuating components of specific frequencies defined by $(2n-1)/2\tau$ (where n is a positive integer) of signals passing through the crosstalk circuits.

6. A signal processing circuit as claimed in claim 5 in which the attenuation means comprises comb filters possessing comb filtering characteristics having dips at said specific frequencies.

7. A signal processing circuit as claimed in claim 5 in which the attenuating means comprises means for adding the output signals of the delay circuits and the input signals of the delay circuits passed through resistors.

8. A signal processing circuit as claimed in claim 5 in which the first and second crosstalk circuits further have frequency characteristic imparting circuits having respectively frequency characteristics substantially corresponding to the differences between the frequency characteristics at the two ears of a listener with respect to a sound source.

9. A signal processing circuit for biphonic use comprising:

a first crosstalk circuit including a delay circuit of a delay time $\tau_1$ and imparting a specific transfer characteristic to a first input signal;

a second crosstalk circuit including a delay circuit of the delay time $\tau_1$ and imparting a specific transfer characteristic to a second input signal, said first and second crosstalk circuits further having, respectively, means for attenuating components of specific frequencies defined by $(2n-1)/2\tau_1$ (where n is a positive integer) of the signals passing through the crosstalk circuits;

first addition means for adding the output signal of the first crosstalk circuit and the second input signal;

second addition means for adding the output of the second crosstalk circuit and the first input signal;

first and second subtraction means respectively supplied with output signals from the first and second addition means and substantially carrying out subtraction;

a third crosstalk circuit including a delay circuit of a delay time $\tau_2$ and operating to impart a specific transfer characteristic to the output signal of the first subtraction means, an output of the third crosstalk circuit being supplied to the second subtraction means;

a fourth crosstalk circuit including a delay circuit of the delay time $\tau_2$ and operating to impart a specific transfer characteristic to the output signal of the second subtraction means, an output of the crosstalk circuit being supplied to the first subtraction means, said third and fourth crosstalk circuits further having, respectively, means for attenuating components of specific frequencies defined by $(2n-1)/2\tau_2$ of signals passing through the crosstalk circuits; and a circuit for deriving output signals from the first and second subtraction means.

* * * * *